US009487927B1

(12) United States Patent
Stebbins

(10) Patent No.: US 9,487,927 B1
(45) Date of Patent: Nov. 8, 2016

(54) IMPACT TOOL

(71) Applicant: Michael Stebbins, Scotts Valley, CA (US)

(72) Inventor: Michael Stebbins, Scotts Valley, CA (US)

( * ) Notice: Subject to any disclaimer, the term of this patent is extended or adjusted under 35 U.S.C. 154(b) by 245 days.

(21) Appl. No.: 14/153,329

(22) Filed: Jan. 13, 2014

(51) Int. Cl.
*E02D 3/046* (2006.01)

(52) U.S. Cl.
CPC ..... *E02D 3/046* (2013.01)

(58) Field of Classification Search
CPC ..... E02D 3/046; B25D 1/00; B25D 1/08; B25D 1/12; B25D 2250/391
USPC ..... 81/19, 20, 22, 26; 404/131.13, 131.1
See application file for complete search history.

(56) References Cited

U.S. PATENT DOCUMENTS 1,415,905 A * 5/1922 Stevens ..... B22C 13/10 404/133.1
2,004,083 A * 6/1935 Scott ..... E02D 3/046 404/133.1
2,669,431 A 2/1954 Crowell
3,211,198 A * 10/1965 Glasgow ..... B25D 1/02 81/19
3,343,576 A * 9/1967 Norcross ..... B25D 1/02 81/19
4,627,499 A 12/1986 Magee et al.
5,150,636 A 9/1992 Hill
5,645,132 A 7/1997 Angsberd
6,129,487 A 10/2000 Bermingham et al.
7,914,233 B2 3/2011 Crane
8,789,549 B1 * 7/2014 Barnes ..... E04H 15/62 135/114
2007/0041787 A1 * 2/2007 Irwin ..... E01C 19/43 404/133.1
2012/0012391 A1 1/2012 Trevisani et al.

OTHER PUBLICATIONS

Ingersoll-Rand, Operation and Maintenance Manual for Models 130A1M and 241A1M Rammers. pp. 1-19. Mar. 1996.

* cited by examiner

*Primary Examiner* — Hadi Shakeri
(74) *Attorney, Agent, or Firm* — Law Office of Michael O'Brien

(57) ABSTRACT

An impact tool is configured to render a force to a desired area. The impact tool includes a handle configured to be manipulated by human hands. A container has a handle tube that is configured to accommodate the handle and the container is hollow. Media is inserted into the container which increases the force rendered by the impact tool. Lifting the impact tool in a lift direction and rapidly lowering the handle in an impact direction that renders the force in the desired area greater than just the force created by acceleration of the human hands in the impact direction, a gravitational force, and the weight of the impact tool.

13 Claims, 4 Drawing Sheets

IMPACT TOOL

BACKGROUND

The embodiments herein relate generally to tools which render and impact in a designated area. Prior to embodiments of the disclosed invention, handheld impact tools had a fixed mass, a fixed geometry and limited use. Embodiments of the disclosed invention permit greater versatility in this regard. The prior art includes: A sand rammer made by Ingersoll Rand; U.S. Pat. No. 7,914,233 issued to Crane; U.S. Patent Application 2012/0012391 filed by Trevisani; U.S. Pat. No. 6,129,487 issued to Bermingham; U.S. Pat. No. 4,627,499 issued to Dillenburg; U.S. Pat. No. 2,669,431 issued to Crowell; U.S. Pat. No. 5,150,636 issued to Hill; and U.S. Pat. No. 5,645,132 issued to Asberg.

The prior art regarding tools for rendering vertical force fits roughly into two categories: first are impact tools that intend to create an impact force on a flat surface and second are drills that create a rotational force and a threaded surface. Ingersoll Rand, Crane and Bermingham are examples of impact tools while Trevisani, Dillenburg and Crowell teach drilling tools.

Ingersoll Rand teaches and air driven impact tool, similar to a jackhammer but designed to level sand. This can be used in a construction work site. The difficulty with using compressible fluids, such as air, is that they require the use of a compressor and create a great deal of vibration for the use.

Crane teaches an impact tool with a conical base wherein the conical base is struck with a pipe. The impact of the pipe against the conical base can be increased by inserting a sock into the pipe and then filling the sock with a ballast, "such as sand, river rock, crushed rock, small diameter stones, gravel, plastic or expanded plastic pellets or a similar material."

Trevisani teaches a drilling machine for excavating a hole. The machine uses a series of cutters to remove soil and then remove the soil through evacuation tubes. There is a guide that is impacting a surface, but this is more to align the machine than to render a vertical force. Ballast can be used to increase the weight of the entire assembly pressing down on the cutters, but not to increase the impact of the guides on the earth. Since the machine moves deliberately though the earth, there is unlikely to be a meaningful impact force.

Bermingham teaches and underwater pile driving tool. The tool impacts a pile submerged in water to drive the pile downward. The tool has a pile cap, of unstated geometry that appears rounded and most of the rest of the tool assures that the pile cap moves downward in an axial manner. The tool proffers that some ballast can be used, but largely to adjust buoyancy and not to otherwise affect the impact of the pile cap.

Dillenburg teaches a drilling tool comprising a drill bit that is attached to a telescoping arm. The telescoping arm is attached to a boom with a water ballast compartment. The water ballast offers additional support, by moving the mass moment of inertia of the system proximate the drilling bit in order to assist the drilling tool.

Crowell teaches an earth drilling machine for drilling under water. A drill bit is attached to a drill pipe section the drill pipe section is attached to a machine anchored to the seabed by water ballast in tanks. Much like the nautical machine in Bermingham, the ballast is used for stability and not for an impact tool.

Hill teaches a process for making a drill bit using cryogenic annealing. The drill bit has a drill face attached to a shank. There is no theory of how to increase or decrease the weight to create a meaningful impact force.

Asberg teaches a drill bit that is impacted with a piston in order to impart percussive shocks for the purpose of penetrating earth and rock. Asberg does not teach a substantially flat lower surface or how impact could be adjusted with ballast.

Having canvassed the prior art, these references are combined in two ways: first combining the impact tool in view of the drill results in the threaded tool with a flat face in Hill. At that point, there is no theory of how to use a ballast to increase the force on the tool. Alternately, combining the drill in view of the impact tool results in the impact drill bit in Asberg, which is configured to administer a vibration to break up earth and does not teach a flattening action.

SUMMARY

An impact tool is configured to render a force to a desired area. The impact tool includes a handle configured to be manipulated by human hands. A container has a handle tube that is configured to accommodate the handle and the container is hollow. Media is inserted into the container which increases the force rendered by the impact tool. Lifting the impact tool in a lift direction and rapidly lowering the handle in an impact direction that renders the force in the desired area greater than just the force created by acceleration of the human hands in the impact direction, a gravitational force, and the weight of the impact tool.

In some embodiments, the handle can be mechanically coupled to the container with a base plate. The container can further comprise a first slot cavity and second slot cavity. The base plate can further comprise a first arm and a second arm. The base plate can be attached to the container by inserting the first arm into the first slot cavity and inserting the second arm into the second slot cavity. The handle tube can further comprise a threaded cavity opening. The base plate can further comprise a threaded cavity having female threads. The handle can further comprise threads at one end. The threaded cavity can be configured to mate with the threaded cavity opening such that the handle can fit through the handle tube mating the threads with the female threads causing the container to be rigidly and immediately adjacent to the base plate.

In some embodiments, the handle tube can be mechanically coupled to a threaded cavity having female threads. The handle can further comprises threads. The threads can be mated with the female threads to mechanically couple the handle to the container.

In some embodiments, the media can be a liquid capable of moving from a bottom surface on the container to increase the force on the bottom surface. In other embodiments, the media can be a granular solid capable of moving from a bottom surface on the container to increase the force on the bottom surface within a predictable range.

In some embodiments, the container can be shaped as a sphere and configured to render a point force to the desired area. In other embodiments, the container can be shaped as a cylinder and configured to render a distributed force to the desired area.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
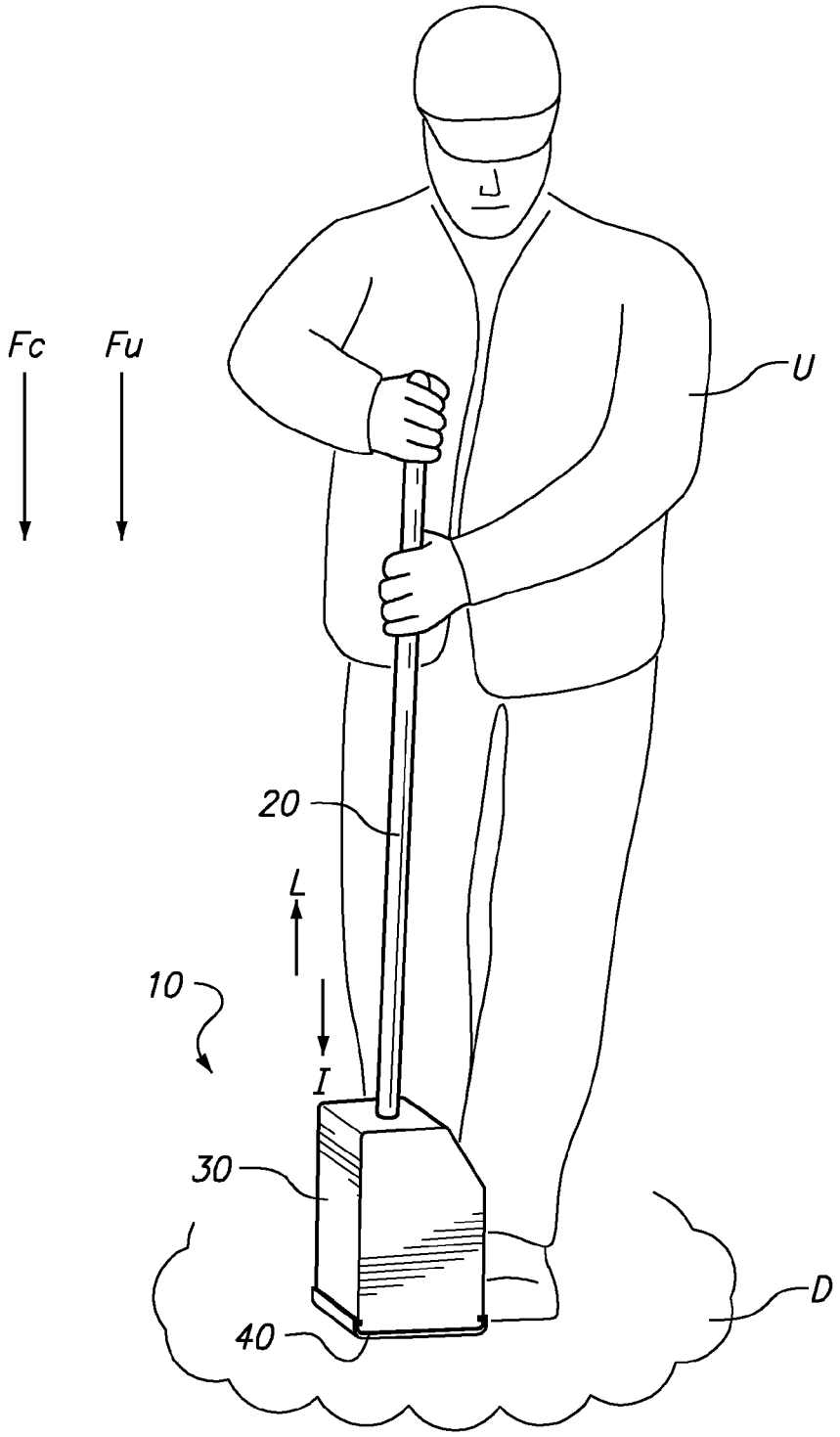
FIG. 1 shows a perspective view of an embodiment of the present invention.

By way of example, and referring to FIG. 1, user U desires to render an impact to a designated area D with human hands H. This can be accomplished with impact tool 10. Impact tool 10 comprises handle 20 and container 30 mechanically coupled to base plate 40. Impact tool can be lifted in the L direction causing contents of container 30 to move in the L direction then rapidly lowering in the I direction that renders the force in desired area D greater than just the force created by acceleration of the human hands in the impact direction FH and a gravitational force FG caused by the weight of impact tool 10.

Figure 2:
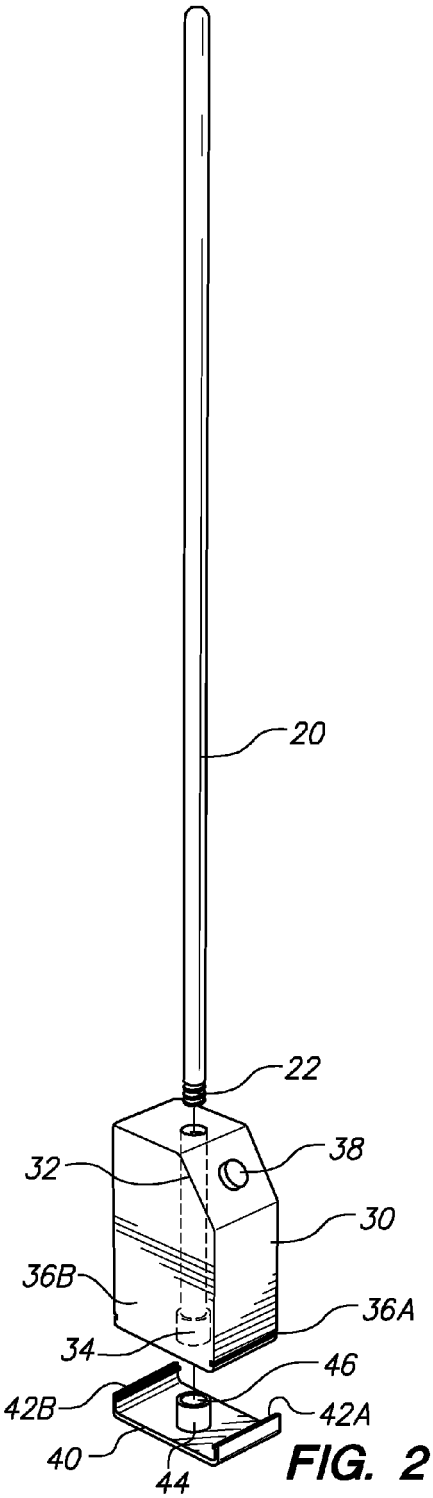
FIG. 2 shows an assembly view of an embodiment of the present invention.
Figure 3A:
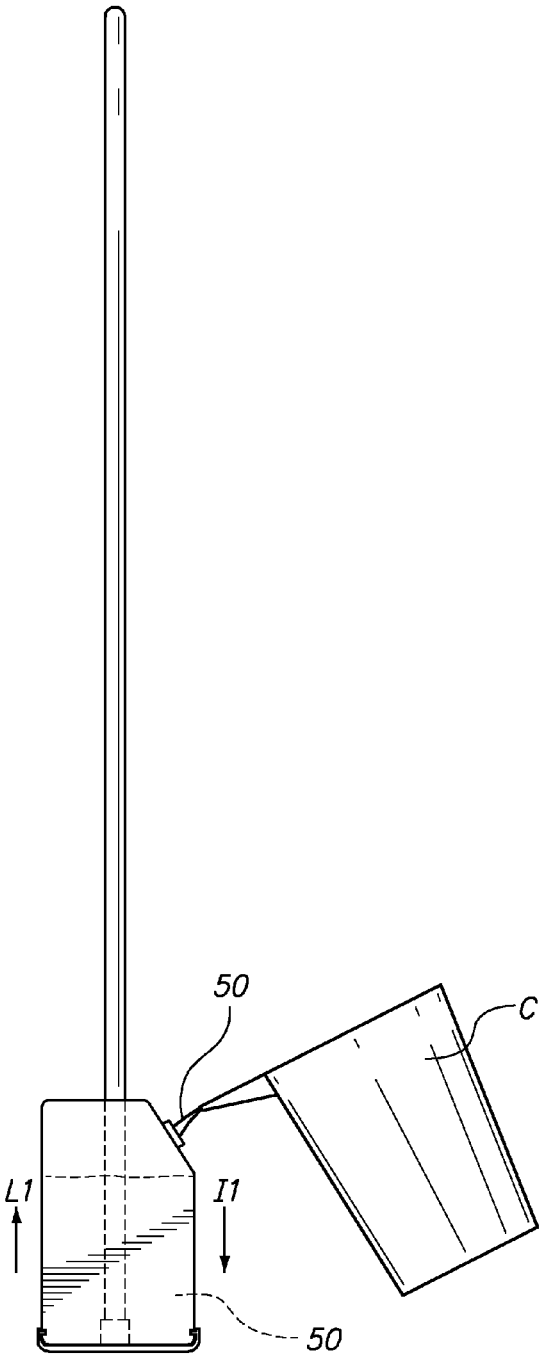
FIG. 3A shows an example of liquid media which can be used within the present invention.
Figure 3B:
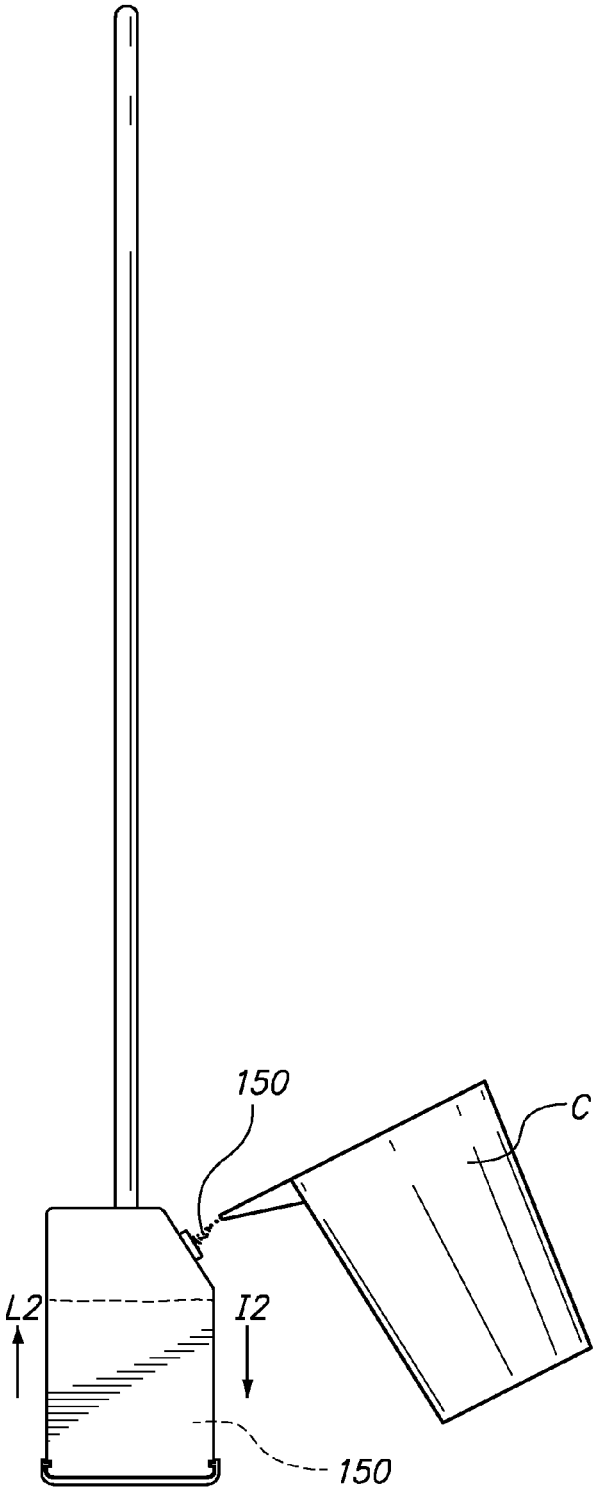
FIG. 3B shows an example of granular solid media which can be used within the present invention.

Turning to FIG. 2, handle 20 further comprises handle threads 22 at one end. Container 30 further comprises handle tube 32 which has a narrow opening at a first end and threaded cavity opening 34 at a second end. Container 30 further comprises first slot cavity 36A on one side and second slot cavity 36B on an opposite side. Container 30 further comprises detachable cap 38 which can be removed to insert media as shown in FIG. 3A and FIG. 3B below. Base plate 40 further comprises first arm 42A and second arm 42B. Base plate 40 is mechanically coupled to a centrally located threaded cavity 44.

To assemble impact tool 10, a user inserts first arm 42A and second arm 42B into first slot cavity 36A and second slot cavity 36B. This causes threaded cavity 44 having female threads 46 to fit inside threaded cavity opening 34. A user can then attach threads 22 to threaded cavity 44 by turning. This should cause container 30 to be rigidly and immediately adjacent to base plate 40. However, base plate 40 can be removed from container 30 by simply removing an arm from a slot cavity with, for instance, a screw driver.

As shown in FIG. 3A, container 30 can be filled with liquid 50 from container C. Liquid 50 can be any known stable liquid such as water. Liquid 50 is, however, not a compressible fluid as the air in Ingersoll Rand. This is because compressible fluids create substantial vibration, which can be damaging to a user's wrists and fingers when operating a hand tool.

Liquid 50 can be assumed to have Newtonian properties such that liquid 50 will move in lift direction L1 upon being lifted and fall in impact direction Il upon making contact with designated area D. The movement of liquid 50 in container 30 greatly magnifies the impact force made by impact tool 10. Liquid 50 travelling in a downward manner will have Force F, as is well known, but the ability to be redirected toward the top of container 30 permits a substantial increase in force which is infinitely variable up to 2 F in a situation where the bottom surface of container 30 is curved (such as FIG. 5A).

As shown in FIG. 3A, container 30 can be filled with granular solid 150 from container C. Granular solid 150 can be any known colloidal substances. Granular solid 150 can be assumed to have pseudo plastic properties such that no minimum shear stress is necessary to deform granular solid 150 and viscosity decreases with a rate of shear. Granular solid 150 will thus move in lift direction L1 upon being lifted and fall in impact direction Il upon making contact with designated area D. The movement of granular solid 150 in container 30 greatly magnifies the impact force made by impact tool 10, but not as much as the Newtonian fluid because the rate of shear is greater. However, the amount of force is substantially more predictable perhaps falling in a predictable range of 1.3 F to 1.5 F.

Figure 4:
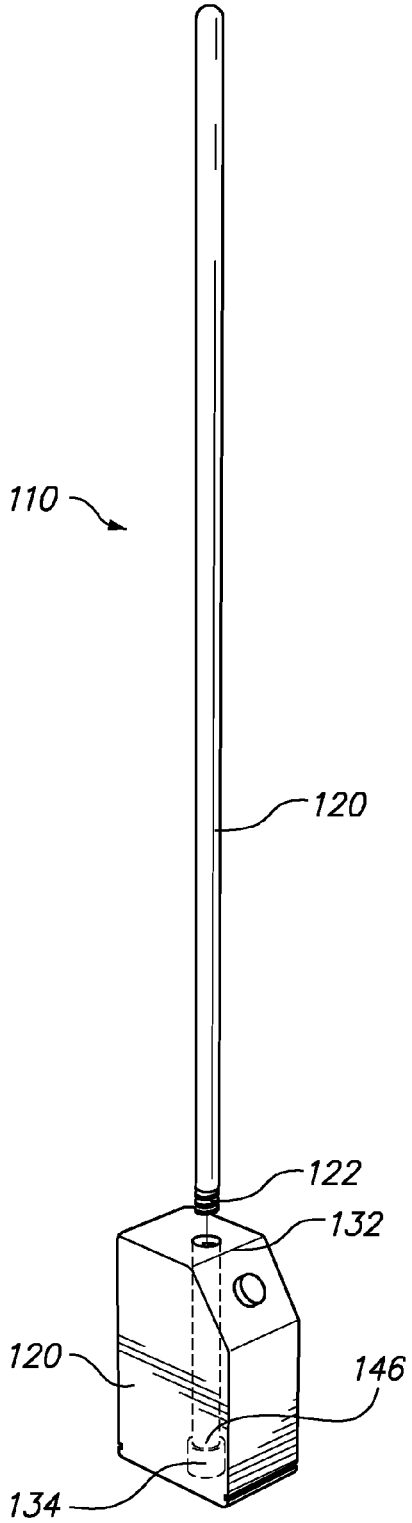
FIG. 4 shows an assembly view of an embodiment of the present invention.

FIG. 4 demonstrates that baseplate 40, while helpful in some regards, and particularly for larger jobs, it is not absolutely essential. For example, in FIG. 4, impact tool 110 comprises handle 120 with threads 122. Container 130 comprises handle tube 132 which terminates in threaded cavity 134 having female threads 146.

Figure 5A:
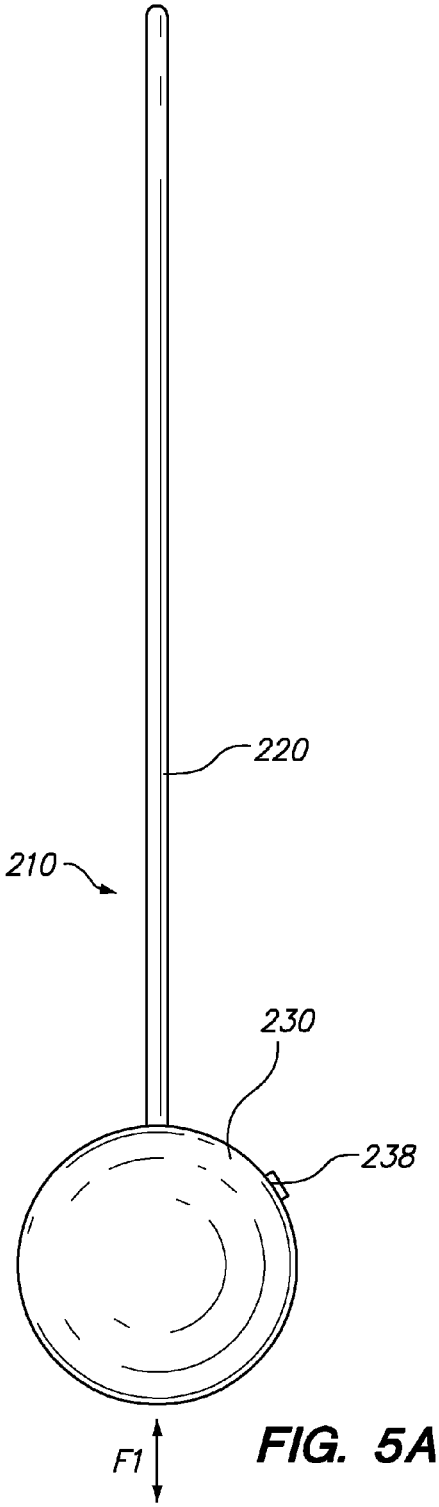
FIG. 5A shows an embodiment of the present invention rendering a point force.
Figure 5B:
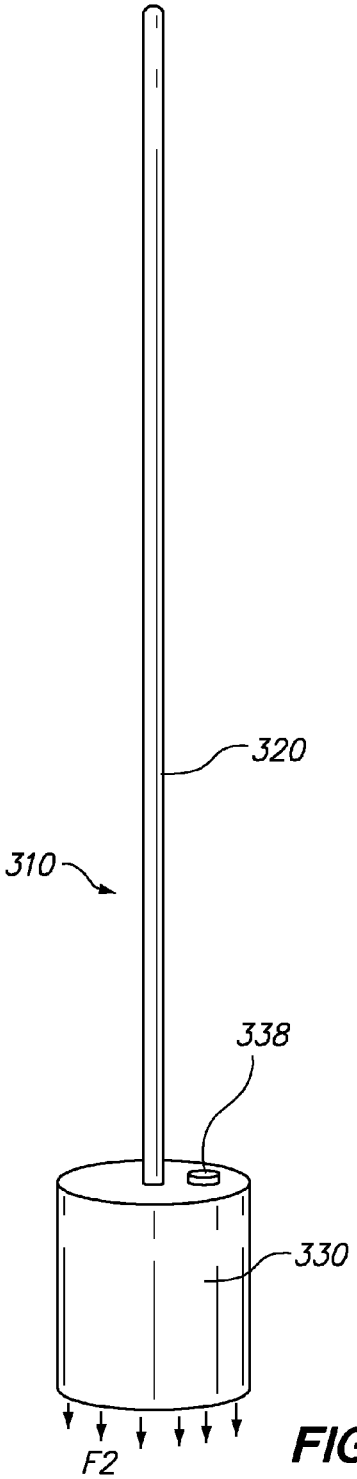
FIG. 5B shows an embodiment of the present invention rendering a distributed force.

Force F exerted by impact tool 10, can be adjusted by changing the shape of container 30 as shown in FIG. 5A and FIG. 5B. FIG. 5A shows impact tool 210. Impact tool 210 comprises handle 220 mechanically coupled to container 230. Notably, handle 220 does not need to go entirely through container 230 in order to be effective, rather handle 220 could be attached to an upper portion of container 230. For instance, impact tool 210 could be machine stamped as a single unit. There are, however, benefits to permitting handle 220 to travel entirely through container 230, notably that the moment on handle 220 is distributed throughout a handle shaft (not shown), which makes impact tool 210 more resistant to fracture.

Container 230 is hollow and can be filled with a media by removing detachable cap 238. Container 230 is shaped as a sphere and is configured to render point Force F1. Delivering point force F1 would be useful for crushing an air filled cavity, such as a milk jug at the bottom of a pile of refuse; the remaining refuse could be displaced while the point force is delivered precisely to desired area D.

This illustrates a number of differences with the prior art. Crane, for instance, utilizes a static media, "in a sock." This prevents the media from pushing against a distal most surface on the impact edge (whether it be the bottom of the container or the base plate). As a result there is no multiplier effect on force F. Now, for a standard fracturing tool like Crane or Asberg, this is not a serious design consideration since the vibration caused by the tool is causing the fracturing as opposed to impact I or force F. In this regard Crane and Asberg are relying on sinusoidal impacts rather than a point force F1 as shown in FIG. 5A or a distributed Force F2 as shown in FIG. 5B.

Turning to FIG. 5B, in some embodiments it can be desirable to apply a distributed force F2 over a substantially larger area than a point force F1 could be applied. To do this, impact tool 310 comprises handle 320 mechanically coupled to container 330. Container 330 is hollow and can be filled with a media by removing detachable cap 338. Container 330 is shaped as a cylinder and is configured to render distributed Force F2. Delivering distributed force F2 would be useful for crushing an uncompressed a pile of refuse in desired area D. In some embodiments, the container can be shaped into an appealing, novel, hollow, and yet still useful figure such as a shape of a human foot or shape of a human fist.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. An impact tool configured to render a force to a desired area; the impact tool comprising:

a handle configured to be manipulated by human hands, wherein the handle comprises a longitudinal axis;

a hollow container comprising a major axis and a minor axis, the container further comprising a handle tube;

the handle tube comprising a hollow channel tube collinear to the major axis and the longitudinal axis, the handle tube further comprising an opening on a first end defining a handle entry side at a top side of the container and a second opening at a second end opposite the first end for mechanically coupling the handle to the container, the handle extending through the handle tube from the first end to the second end;

fluent media, inserted into the container, partially filling the container around the handle tube, which increases the force rendered by the impact tool;

wherein lifting the impact tool in a lift direction and rapidly lowering the handle in an impact direction that renders the force in the desired area greater than just the force created by acceleration of the human hands in the impact direction, a gravitational force, and weight of the impact tool.

2. The impact tool of claim 1, wherein the handle is mechanically coupled to the container with a base plate.

3. The impact tool of claim 2, wherein the container further comprises a first slot cavity and second slot cavity; the base plate further comprises a first arm and a second arm; wherein the base plate is attached to the container by inserting the first arm into the first slot cavity and inserting the second arm into the second slot cavity.

4. The impact tool of claim 2, wherein the base plate further comprises a threaded cavity having female threads; the handle further comprises threads at one end; wherein the threaded cavity is configured to mate with the second opening such that the handle can fit through the handle tube mating the threads with the female threads causing the container to be rigidly and immediately adjacent to the base plate.

5. The impact tool of claim 1, wherein the handle tube is mechanically coupled to a threaded cavity having female threads defined by a base plate; the handle further comprises threads wherein the threads are mated with the female threads to mechanically couple the handle to the container.

6. The impact tool of claim 1, wherein the media is a liquid capable of moving from a bottom surface on the container to increase the force on the bottom surface.

7. The impact tool of claim 1, wherein the media is a granular solid capable of moving from a bottom surface on the container to increase the force on the bottom surface within a predictable range.

8. The impact tool of claim 1, wherein the container is shaped as a sphere having the major axis being equal to the minor axis and configured to render a point force to the desired area.

9. The impact tool of claim 1, wherein the container is shaped as a cylinder and configured to render a distributed force to the desired area.

10. An impact tool configured to render a force to a desired area; the impact tool comprising:

a handle configured to be manipulated by human hands;

a container further comprising a handle tube configured to accommodate the handle; wherein the container is hollow; wherein the container further comprises a first slot cavity and second slot cavity;

wherein the handle is mechanically coupled to the container with a base plate;

wherein the base plate further comprises a first arm and a second arm; wherein the base plate is attached to the container by inserting the first arm into the first slot cavity and inserting the second arm into the second slot cavity;

media, inserted into the container which increases the force rendered by the impact tool;

wherein lifting the impact tool in a lift direction and rapidly lowering the handle in an impact direction that renders the force in the desired area greater than just the force created by acceleration of the human hands in the impact direction, a gravitational force, and weight of the impact tool.

11. The impact tool of claim 10, wherein the handle tube is mechanically coupled to a threaded cavity having female threads defined by the base plate; the handle further comprises threads wherein the threads are mated with the female threads to mechanically couple the handle to the container.

12. The impact tool of claim 10, wherein the media is a liquid capable of moving from a bottom surface on the container to increase the force on the bottom surface.

13. The impact tool of claim 10, wherein the media is a granular solid capable of moving from a bottom surface on the container to increase the force on the bottom surface within a predictable range.

* * * * *